US006457548B1

(12) United States Patent
D'Hoogh

(10) Patent No.: US 6,457,548 B1
(45) **Date of Patent: *Oct. 1, 2002**

(54) PASSIVE RADIATOR WITH MASS ELEMENTS

(75) Inventor: Guido O. M. D'Hoogh, Dendermonde (BE)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/510,851

(22) Filed: Feb. 23, 2000

(30) Foreign Application Priority Data

Jun. 7, 1999 (EP) ..... 99201810

(51) Int. Cl.[7] ..... G10K 13/00; H04R 25/00

(52) U.S. Cl. ..... 181/171; 181/156; 181/172; 381/193

(58) Field of Search ..... 181/171, 172, 181/173, 174, 166, 156; 381/188, 192, 193, 198, 205

(56) References Cited

U.S. PATENT DOCUMENTS 3,669,215 A 6/1972 Kikuchi et al.
5,847,333 A * 12/1998 D'Hoogh ..... 181/171
5,892,184 A * 4/1999 D'Hoogh ..... 181/171
6,044,925 A * 4/2000 Sahyoun ..... 181/171

FOREIGN PATENT DOCUMENTS

| | | |
|---|---|---|
| WO | WO9119405 | 12/1991 |
| WO | WO9746046 | 12/1997 |
| WO | WO9746047 | 12/1997 |

* cited by examiner

*Primary Examiner*—Khanh Dang

(57) ABSTRACT

A passive radiator comprising a frame (1) and a radiator body (3) which is connected to the frame and which is movable relative to the frame along a translation axis (T). The radiator is suitable for the displacement of comparatively large air volumes. The radiator body comprises a central mass element (3*a*) and at least one mass element (3*b*, 3*c*, 3*d*) which is concentrically arranged with respect to the central mass element. The radiator further comprises connection units (5*a*, 5*b*, 5*c*, 5*d*) for the movable interconnection of each pair of adjoining mass elements and for the movable fastening of one of the mass elements to the frame. Each of said connection units comprises at least a resilient annular connection element (5*a*1, 5*a*2; 5*b*1, 5*b*2; 5*c*1, 5*c*2; 5*d*1, 5*d*2), such that the central mass element with its adjoining connection unit forms a mass spring system, as does each concentrically arranged mass element with its adjoining connection element, while all mass spring systems thus defined have at least substantially the same resonance frequency.

11 Claims, 3 Drawing Sheets

PASSIVE RADIATOR WITH MASS ELEMENTS

BACKGROUND OF THE INVENTION

The invention relates to a passive radiator comprising a frame and a radiator body which is connected to said frame and which is movable with respect to said frame along a translation axis.

Such a radiator is known from U.S. Pat. No. 3,669,215 and is designed for use in a bass reflex loudspeaker system. The known passive radiator comprises a basket-shaped frame and a conical body which is suspended from the frame. The suspension used consists of a deformable suspension ring which extends between a greatest circumferential rim of the conical body and the frame. A plate is fastened to the smallest circumferential rim of the conical body and is also fastened to a back part of the frame via three elastic wire elements. This suspension allows of limited axial displacements of the conical body with respect to the frame only, so that major volume displacements, i.e. displacements of major quantities of air, are only possible if the conical body has large lateral dimensions.

OBJECTS AND SUMMARY OF THE INVENTION

It is an object of the invention to improve the passive radiator mentioned in the opening paragraph such that displacements of comparatively large air volumes are possible while the radiator has limited transverse dimensions.

This object is achieved with the passive radiator according to the invention which is characterized in that the radiator body comprises a central mass element and at least one mass element concentrically positioned with respect to the central mass element, while connection units are present for the movable interconnection of every two mutually adjoining mass elements and for the movable fastening of one of the mass elements to the frame, each of said connection units comprising at least a resilient annular connection element, the central mass element with its adjoining connection unit forming a mass spring system, as does each conically positioned mass element with its adjoining connection elements, while all mass spring systems present and thus defined have at least substantially the same resonance frequency.

The use of two or more mass elements which are interconnected by resilient connection elements leads to a construction with a multiple suspension in which each mass element present contributes to the total air displacement during use. A mass element performs individual movements with respect to an adjoining mass element along the translation axis of the radiator body during operation, which results in displacements with respect to the frame which are cumulations of individual movements. Comparatively large displacements of mass elements can be realized in this manner, so that considerable volume displacements can be achieved with a comparatively small radiator body. To counteract parasitic resonances during use, it was found to be necessary for the mass spring systems present in the passive radiator according to the invention as defined above to have the same or practically the same resonance frequency. If this requirement is not complied with, movements of individual mass elements may get out of phase, so that serious sound distortions and/or attenuations may arise during use. Damping means may be used, if so desired, for counteracting irregularities in movements of individual mass elements.

It is noted that WO-A 97/46047 (PHN 15.840) discloses a passive radiator which comprises a frame, a mass element, and a sub-frame extending between the mass element and the frame, while the mass element is movably fastened to the sub-frame by means of a first resilient suspension ring and the sub-frame is movably fastened to the frame by means of a second resilient suspension ring. The maximum stroke of the mass element is defined by the sum of the maximum strokes of each of said suspension rings. Although a reasonably large volume displacement is possible with this known construction, it was found that a greater maximum stroke is desirable at higher powers so as to prevent harmonic distortion in the low frequency range.

An embodiment of the passive radiator according to the invention is characterized in that the connection units allow mainly of movements of the mass elements along the translation axis of the radiator body and counteract other movements. It is prevented in this embodiment that the mass elements perform disadvantageous tilting movements with respect to one another during operation, which tilting movements could lead to distortions in the sound reproduction. The annular connection elements used may be made from resilient materials which are known per se such as polyurethane or rubber and preferably each have a folded or wave structure. Shape and dimensions of the connection elements lie within comparatively narrow limits which are defined inter alia by the required resistance to pressure variations which occur during operation and the capacity of deforming in a flexible manner, i.e. without disadvantageous effects such as kinking or abutting, during the movement of the mass elements. A connection element which is too slack and/or not flexibly deformable gives rise to undesirable distortions, especially distortions of the second and higher order, in the sound reproduction and accordingly to unpleasant additional noises. An increase in the size of the suspension ring of the radiator known from U.S. Pat. No. 3,664,215 or an increase in the size of the suspension rings of the radiator known from WO-A 97/46047 will not lead to satisfactory results for this reason. A greater volume displacement achieved in that manner will in fact be accompanied by an impaired sound reproduction quality.

An embodiment of the radiator according to the invention is characterized in that at least a number of the connection elements comprise a further resilient annular connection element, which further connection element and the connection element mentioned earlier of such a connection unit are at a distance from one another, measured along the translation axis of the radiator body. This embodiment is particularly suitable if, instead of a plane or thin radiator body, a radiator body with a considerable axial dimension is used, i.e. a dimension in a direction parallel to the translation axis of the radiator body. The specific configuration of connection elements used in the present embodiment safeguards well-defined displacements of the mass elements of the radiator body, so that swinging movements as a result of pressure variations and/or parasitic resonances can be avoided.

An embodiment of the radiator according to the invention is characterized in that the number of mass elements is three or four. Although a different number of mass elements is possible, it was found that a design with three or four mass elements can be well realized in practice for achieving a displacement of a comparatively large air volume.

An embodiment of the radiator according to the invention is characterized in that the connection elements are mutually identical. This embodiment is preferable if the object is to give each mass element the same maximum axial stroke with respect to its adjoining mass element or adjoining mass elements. In a practical embodiment, the connection elements may be, for example, omega-shaped. Any further connection elements, if present, are preferably provided in mirrored positions with respect to the other connection elements so as to prevent asymmetry in the displacements and amplitudes of the mass elements.

An embodiment of the radiator according to the invention is characterized in that at least a number of the connection elements are of mutually different sizes, said size increasing in a direction away from the central mass element. It is achieved by this measure that an annular mass element is capable of performing a relatively greater maximum displacement than a central mass element which is present, i.e. compared with its respective adjoining central or more centrally positioned mass element each time. An advantage of this configuration is that the strokes of the connection elements are optimally utilized without undesirable deformations of the connection elements occurring.

An embodiment of the passive radiator according to the invention is characterized in that the radiator body and the connection units are together constructed as one integral unit. The mass elements and the connection elements in such a unit are preferably manufactured from one material, such as rubber. The integral unit may be constructed as a skin, in particular a thin skin, which is fastened with its circumferential edge to the frame. The number of mass elements in this embodiment may be much larger than the number of three or four mentioned elsewhere in this description.

The invention further relates to a loudspeaker system comprising a housing or cabinet which accommodates an electrodynamic loudspeaker and a passive radiator. The loudspeaker may be of any type which is known per se. The passive radiator present in the loudspeaker system according to the invention is constructed as defined in one of the claims 1 to 7. The connection units and the passive radiator in the system according to the invention allow of mutual displacements of the mass elements defined by pressure variations in the housing, which displacements result in comparatively large air displacements, so that a comparatively large sound pressure can be achieved.

Preferably, the loudspeaker system according to the invention is constructed as defined in claim 9. It is safeguarded in such a system that the various connection units allow of strokes under the influence of pressure variations in the housing which are fully attuned to the total moving mass of the radiator and the tuning frequency, the so-called Helmholz resonance, of the system.

The invention further relates to a device for providing audible, and possibly also visible information, which device according to the invention is provided with the loudspeaker system according to the invention.

It is noted about the claims that various combinations of characteristics as defined in the dependent claims are possible.

BRIEF DESCRIPTION OF THE DRAWINGS

The invention will now be explained in more detail by way of example with reference to the drawing, in which FIG. 1 diagrammatically and in longitudinal section shows a first embodiment of the passive radiator according to the invention, FIG. 2 diagrammatically and in longitudinal section shows a second embodiment of the radiator according to the invention, FIG. 3 diagrammatically and in longitudinal section shows a third embodiment of the radiator, FIG. 4 diagrammatically and in longitudinal section shows an embodiment of the loudspeaker system according to the invention.

DETAILED DESCRIPTION OF THE PREFERRED EMBODIMENT

Figure 1:
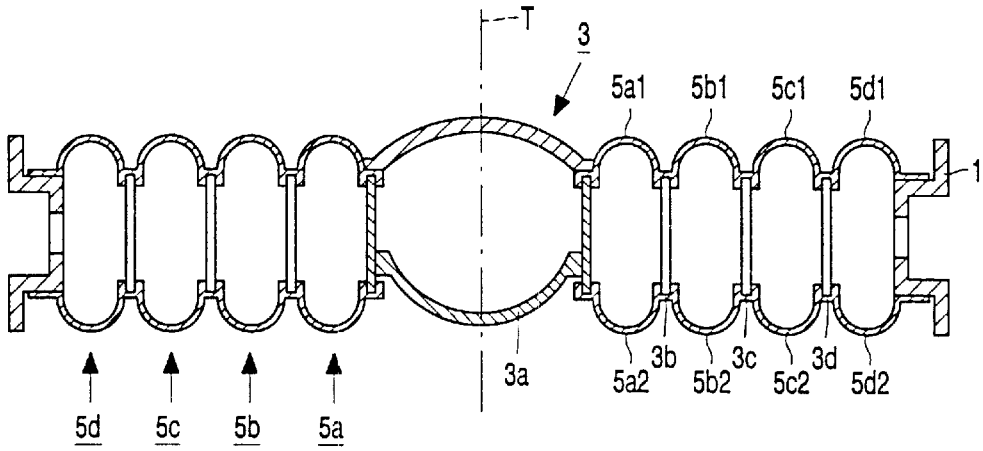

The passive radiator according to the invention shown in FIG. 1 is suitable for use in a bass reflex loudspeaker system. The radiator comprises a frame 1, a radiator body 3 which is movable relative to the frame 1 along a translation axis T, and connection means for flexibly connecting the radiator body 3 to the frame 1. The frame 1 in this example is cylindrical. The radiator body 3 in this example comprises a central mass element 3*a* and three mass elements 3*b*, 3*c* and 3*d* which are concentrically arranged around the mass element 3*a*. The central mass element 3*a* in this example is constructed as a cylinder with two closed, convex end faces. The other mass elements 3*b*, 3*c* and 3*d* in this example are also cylinders, but they have open end faces. The cylinders may be provided with closed cylinder walls or with more or less open cylinder walls. Said connection means in this example comprise four connection units 5*a*, 5*b*, 5*c* and 5*d*. The three connection units Sa, Sb and Sc serve for connecting the two respective adjoining mass elements 3*a* and 3*b* ; 3*b* and 3*c*; and 3*c* and 3*d* so as to be mutually movable each time. The connection unit 5*d* serves for movably connecting the mass element 3*d* to the frame 1. In this example, each of the connection units 5*a*, 5*b*, 5*c* and 5*d* are formed from two annular connection elements 5*a*1, 5*a*2; 5*b*1, 5*b*2; 5*c*1, 5*c*2; and 5*d*1, 5*d*2, respectively. These connection elements in this example have an omega-shaped cross-section and are manufactured from rubber. The annular connection elements are connected at their edges to the mass elements 3*a*, 3*b*, 3*c* and 3*d* and to the frame 1, as applicable, by means which are known per se, such as glue, and on account of their shapes and material properties have a behavior such that mainly movements of the mass elements 3*a*, 3*b*, 3*c* and 3*d* along the translation axis T are admitted during use, while undesirable tilting movements of the mass elements are counteracted. In this example, the connection elements are mutually identical, while a symmetrical suspension arrangement is obtained in that the wave crests of two mutually opposed connection elements 5*a*1 and 5*a*2; 5*b*1 and 5*b*2; 5*c*1 and 5*c*2; and 5*d*1 and 5*d*2 face away from each other.

Four mutually independent mass spring systems are present in the passive radiator according to the invention as shown in FIG. 1. These mass spring systems are formed by the mass element 3*a* with its adjoining connection unit 5*a* (or its adjoining connection elements 5*a*1 and 5*a*2); the mass element 3*b* with its adjoining connection elements 5*a*1, 5*a*2 and 5*b*1, 5*b*2; the mass element 3*c* with its adjoining connection elements 5*b*1, 5*b*2 and 5*c*1, 5*c*2; and the mass element 3*d* with its adjoining connection elements 5*c*1, 5*c*2 and 5*d*1, 5*d*2.

One of the characteristic features of the embodiment shown is that these mass spring systems all have the same or substantially the same resonance frequency so as to ensure that the mass elements 3*a*, 3*b*, 3*c* and 3*d* always move in phase during operation. A reliable operation of the passive radiator is safeguarded by this measure, with the maximum displacement of the central mass element 3*a* from its idle position, which is the position shown in FIG. 1, being the sum of the maximum displacements allowed by the individual connection units 5*a*, 5*b*, 5*c* and 5*d*. It will be obvious that the maximum displacement of the mass element 3*b* is the sum of the maximum strokes of the individual connection units 5*b*, 5*c* and 5*d*; the maximum displacement of the mass element 3*c* is the sum of the maximum strokes of the connection units 5*c*. and 5*d*, and the maximum displacement of the mass element 3*d* corresponds to the maximum stroke of the connection unit 5*d*. Large air displacements are rendered possible by the comparatively great maximum displacement of the radiator body 3 obtained here.

Figure 2:
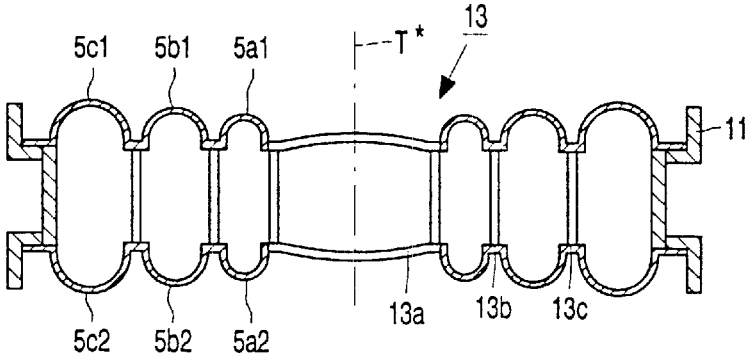

The passive radiator according to the invention shown in FIG. 2 has an annular frame 11 and a radiator body 13 which comprises a number of mass elements. The radiator body 13 is displaceable relative to the frame 11 along a translation axis T*. In this example, the radiator body 13 has a cylindrical central mass element 13*a* and two cylindrical mass elements 13*b* and 13*c*. The mass elements 13*a*, 13*b* and 13*c* all lie in one and the same zone and are arranged mutually coaxially, with the translation axis T* as the common axis. The mass elements 13*a*, 13*b* and 13*c* are mechanically interconnected two-by-two by means of pairs of resilient annular connection elements 5*a*1, 5*a*2 and 5*b*1, 5*b*2, respectively. The mass element 13*c* is also mechanically connected to the frame 11 by means of a pair of resilient annular connection elements 5*c*1 , 5*c*2. The configuration of mass elements 13*a* , 13*b* and 13*c* and connection elements 5*a*1, 5*a*2; 5*b*1, 5*b*2; and 5*c*, 5*c*2 as used in this embodiment implies that there are three mass spring systems. These mass spring systems are formed by the mass element 13*a* and the pair of connection elements 5*a*1, 5*a*2; by the mass element 13*b* and the connection elements 5*a*1, 5*a*2 and 5*b*1, 5*b*2; and by the mass element 13*c* and the connection elements 5*b*1, 5*b*2 and 5*c*1, 5*c*2; respectively. All these mass spring systems have the same resonance (or natural) frequency. The connection elements used 5*a*1, 5*a*2; 5*b*1, 5*b*2; 5*c*1, 5*c*2 are all flexible and yielding in directions parallel to the translation axis T* and offer sufficient resistance to lateral deformations. The connection elements differ in size in this embodiment, the object of this being to render possible mutually differing displacements of the mass elements 13*a*, 13*b* and 13*c* in axial directions, i.e. in directions parallel to the translation axis T*. In this example, the pair of connection elements 5*a*1, 5*a*2 allows of the smallest axial displacement, and the pair of connection elements 5*c*1, 5*c*2 allows of the greatest axial displacement. The maximum absolute displacement of the individual mass elements 13*a*, 13*b* and 13*c*, in other words the maximum displacement relative to the frame 11, obviously rises in the order 13*c*, 13*b*, 13*a*, the central mass element 13*a* thus having the greatest maximum absolute displacement or amplitude.

Figure 3:
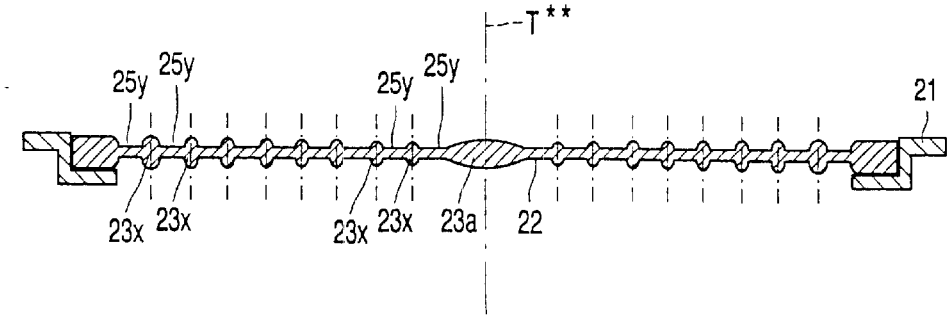

The passive radiator according to the invention shown in FIG. 3 has a frame 21 and a foil 22 which is fastened to the frame 21 and which can yield along a translation axis T. The foil 22, for example made of rubber, has been provided with a concentric structure, for example by means of variations in thickness or density, such that it comprises a central mass element 23*a* and a large number of annular mass elements 23*x* and annular connection elements 25*y* which in mutual conjunction constitute mass spring systems with the same resonance frequency each time. The foil 22 accordingly is a unit in which a radiator body with mass elements and connection elements for the flexible connection of the radiator body to the frame and for the mutual flexible connection of the mass elements has been integrally accommodated. Suitable structures for this may be determined by means of computer calculations and/or simulations.

Figure 4:
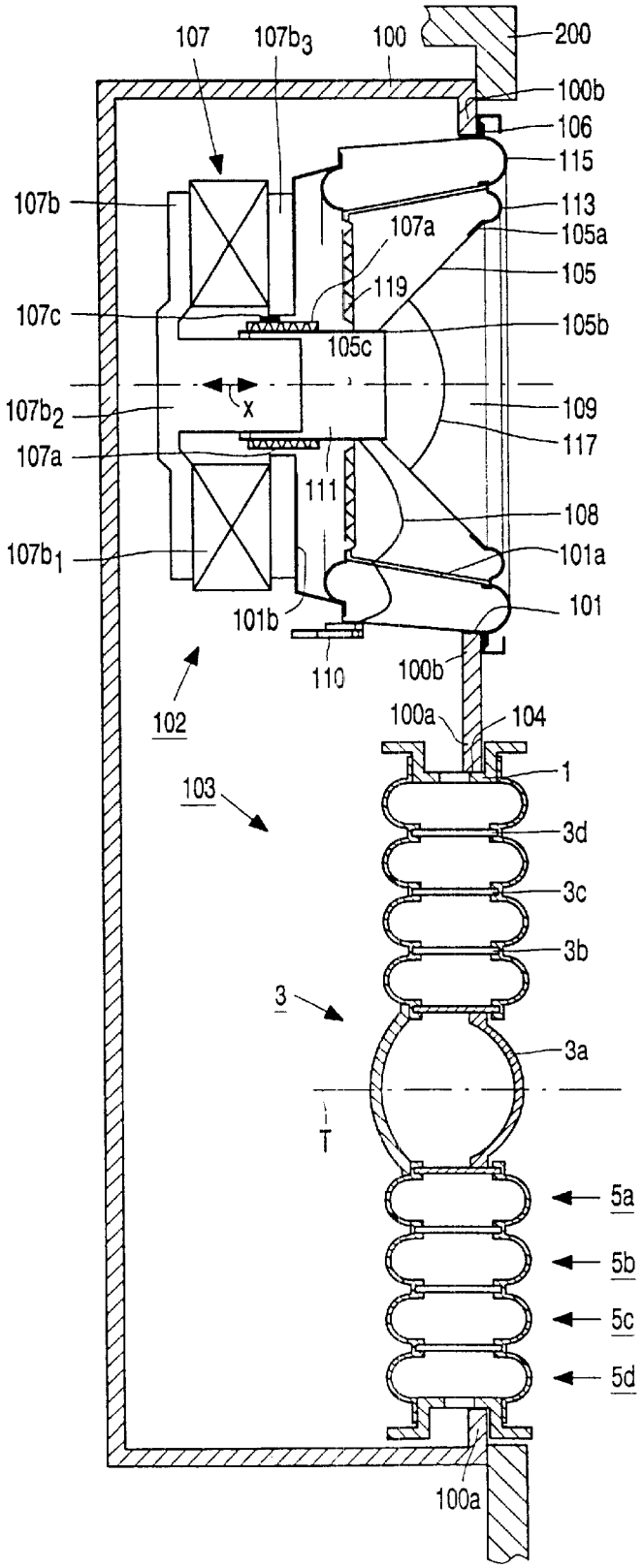

The loudspeaker system according to the invention shown in FIG. 4, a bass reflex system, comprises a housing or resonance box 100 in which a passive radiator according to the invention, in this example the embodiment shown in FIG. 1 and indicated with reference numeral 103, and an electrodynamic loudspeaker 102 are present. The loudspeaker 102 drives the radiator 103 during operation, the loudspeaker and radiator in that case together ensuring the sound production in the low-frequency range of the sound spectrum. The system is accordingly a sub-woofer device. The housing 100 of the system is provided with a first opening 104 through which the frame 1 of the passive radiator 103 is passed, and with a second opening 106 through which a frame 101 of the loudspeaker 102 is passed. The frame 1 and the frame 101 are fastened to the edge portions 100*a* and 100*b* of the housing surrounding the openings 104 and 106, respectively.

For a further description of the passive radiator, the reader is referred to the passages in the present document relating to FIG. 1, while it should be noted that the resonance frequency of the mass spring systems present is equal to the Helmholz resonance of the system.

The loudspeaker 102 used in the system shown comprises a sub-frame 101*a*, a membrane 105, and an electromagnetic actuator 107. The sub-frame 101*a*, which is conical in this example, extends between the frame 101 and the conical membrane 105. A dust cover 117 is present in the membrane 105 in this example. The sub-frame 101*a* has a closed enveloping surface, opposite which reverberation openings may be present in the frame 101. The membrane 105 has a front part 105*a* with an opening 109 and a rear part 105*b* with a tubular central element 111. A first actuator part 107*a*, in the form of a coil in this example, of the actuator 107 is present on the element 111. The coil 107*a* is electrically connected via electrical conductors 108 to connection contacts 110 fastened to the frame 101. The actuator 107 further comprises a second actuator part 107*b*, which is provided with an annular magnet 107*b*1, a yoke part 107*b*2, and a yoke part 107*b*3 fastened to a frame part 101*b* of the frame 101 in this example. An air gap 107*c*, in which the coil 107*a* extends, is present between the yoke parts 107*b*2 and 107*b*3. When the actuator is energized, the coil 107*a*, and thus the membrane 105, will perform an axial displacement along a membrane axis 105*c* in either of the axial directions indicated with a double arrow X.

The membrane 105 is suspended in the sub-frame 101*a*, and the sub-frame 101*a* is suspended in the frame 101 in the loudspeaker 102. The loudspeaker 102 is for this purpose provided with a first flexible connection element 113, which connects the front part 105*a* of the membrane 105 to the sub-frame 101*a*, and with a second flexible connection element 115 which connects the sub-frame 101*a* at the level of the front part 105*a* to the frame 101. The connection elements 113 and 115 in this example are constructed as annular elements with omega-shaped cross-sections. The connection elements 113 and 115, for example made from polyurethane, may be fastened to the membrane 105 and the sub-frame 101*a*, and the subframe 101*a* and the frame 101, respectively, by means of glue connections. Preferably, the first connection element 113 and the second connection element 115, which extend coaxially relative to one another, are constructed as one flexible element.

A flexible centering element 119 is furthermore present in the loudspeaker 102, in this example in the form of a centering disc with a concentric wave pattern made from a suitable material, such as a textile fabric, which connects the sub-frame 101*a* to the back part 105*b*, in particular to the central element 111 thereof. The centering element 119 and the connection elements 113 and 115 are bearing means which are comparatively slack and yielding in axial directions along arrow X, but are comparatively stiff in other directions, so that the membrane 105 with the coil 107*a*, including the sub-frame 101*a*, are capable of performing well-defined axial displacements with respect to the frame 101. Obviously a different loudspeaker from the loudspeaker shown may be used, such as a loudspeaker element with a single suspended vibration system.

Figure 5:
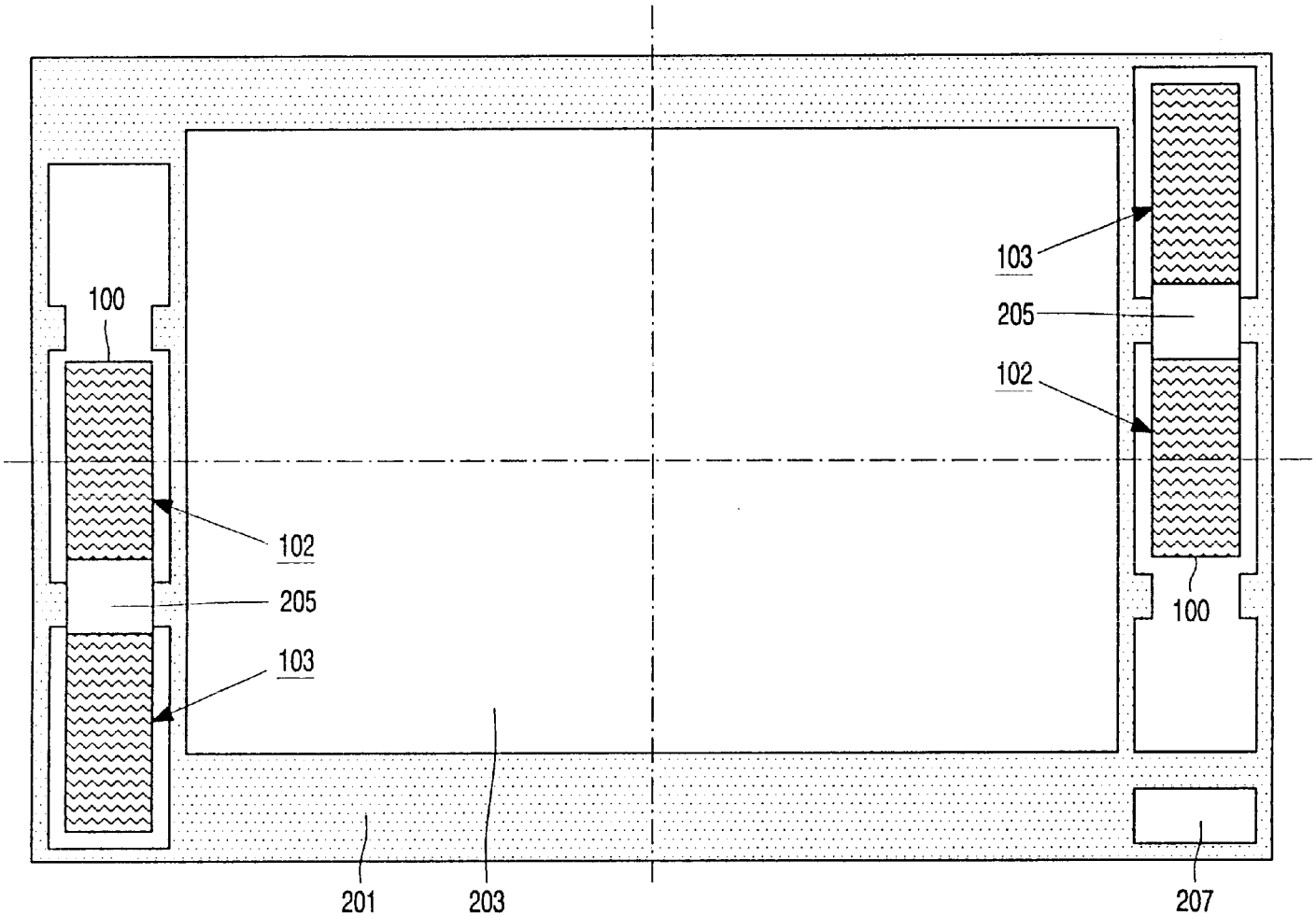
FIG. 5 is a diagrammatic front elevation of an embodiment of the device according to the invention.

The device according to the invention shown in FIG. 5 is a flat-panel multimedia TV set. The device is provided with a cabinet 201 in which a picture screen 203 and two loudspeaker systems according to the invention are present. The cabinet 201 has an on/offswitching unit 207 at its front side. The loudspeaker systems in this example correspond to the loudspeaker system as shown in FIG. 4 and have the reference numeral 205 in FIG. 5. Each loudspeaker system 205 accordingly has a housing 100 with a loudspeaker 102 and a passive radiator 103 according to the invention. Instead of the device shown, the device according to the invention may alternatively be a conventional TV set, a monitor, or a piece of audio equipment. Furthermore, the radiator used in the device may be constructed as shown in FIGS. 2 or 3 or in some other manner which lies within the scope of the invention, and a loudspeaker different from the loudspeaker shown in FIG. 4 may be used. Furthermore, the invention is not limited to the embodiments of the radiator shown in FIGS. 1 and 2. Instead of three or four mass elements, two or more than four mass elements may thus be used, and sinusoidal or alternatively shaped suitable connection elements may be used instead of omega-shaped connection elements.

I claim:

1. An apparatus including a passive radiator comprising a frame and a radiator body connected to the frame and movable with respect to the frame along a translation axis, the radiator body including:

a plurality of mass elements including a central mass element; and a plurality of connection units, each of which includes a respective first resilient annular connection element, each mass element of the plurality of mass elements being concentrically, movably connected with at least one other of the plurality of mass elements via a respective one of the plurality of connection units, with at least one of the mass elements being movably fastened to the frame, such that:

the plurality of mass elements and the plurality of connection units form an alternating series of mass elements and connection units, every adjacent pair of mass elements of the series connected by a respective one of the connection units forms a respective mass spring system, and every one of the respective mass spring systems possesses a resonance frequency that is substantially the same as the resonance frequency of every other one of said respective mass spring systems.

2. The apparatus of claim 1, in which the connection units allow movements of the mass elements substantially only along the translation axis of the radiator body and counteract other movements.

3. The apparatus of claim 2, in which at least one of the connection units comprises a second resilient annular connection element positioned at a distance from the first resilient annular connection element of that same connection unit, as measured along the translation axis of the radiator body.

4. The apparatus of claim 1, including three or four mass elements.

5. The apparatus of claim 1, in which the plurality of resilient annular connection units are substantially structurally identical to one another.

6. The apparatus of claim 1, in which at least a subset plurality of the plurality of connection units are of mutually different sizes, said sizes increasing as distance from the central mass element of a respective one of the subset plurality of connection units increases.

7. The apparatus of claim 1, in which the radiator body and the connection units are together constructed as one integral unit.

8. The apparatus of claim 1, in which the apparatus includes a loudspeaker system including a housing that accommodates an electrodynamic loudspeaker and the passive radiator.

9. The apparatus of claim 8, wherein the resonance frequency of the mass spring systems is equal to the Helmholz frequency of the housing with the loudspeaker and passive radiator accommodated therein.

10. The apparatus of claim 9, further including means for providing at least one of audible and visible information.

11. The apparatus of claim 8, further including means for providing at least one of audible and visible information.

* * * * *